US009380661B2

(12) United States Patent
Takahashi et al.

(10) Patent No.: US 9,380,661 B2
(45) Date of Patent: Jun. 28, 2016

(54) LIGHTING SOURCE AND LIGHTING APPARATUS

(71) Applicant: PANASONIC CORPORATION, Osaka (JP)

(72) Inventors: Akira Takahashi, Osaka (JP); Kazuhiro Takeda, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 66 days.

(21) Appl. No.: 14/458,402

(22) Filed: Aug. 13, 2014

(65) Prior Publication Data

US 2015/0077000 A1 Mar. 19, 2015

(30) Foreign Application Priority Data

Sep. 13, 2013 (JP) ..... 2013-191004

(51) Int. Cl.
*H05B 37/02* (2006.01)
*H05B 33/08* (2006.01)

(52) U.S. Cl.
CPC ..... *H05B 33/0815* (2013.01); *H05B 33/086* (2013.01); *H05B 33/0857* (2013.01)

(58) Field of Classification Search
CPC .... H05B 37/00; H05B 37/02; H05B 33/0803; H05B 33/0809; H05B 33/0815; H05B 33/0821; H05B 33/0857; H01L 33/00
USPC ..... 315/119–125, 185 R, 209 R, 291, 307, 315/308, 312
See application file for complete search history.

(56) References Cited

U.S. PATENT DOCUMENTS 8,773,043 B2 * 7/2014 Masuda ..... H05B 33/0815 315/294
2008/0224025 A1 9/2008 Lyons et al.
2012/0200229 A1 8/2012 Kunst et al.
2014/0225525 A1 8/2014 Lin (Continued)

FOREIGN PATENT DOCUMENTS

DE 202010005328 11/2010
JP 2009-009782 1/2009

OTHER PUBLICATIONS

German Office Action, mailed Apr. 16, 2015, for the corresponding German Patent Application No. 102014111740.9 (together with English language translation thereof).

(Continued)

*Primary Examiner* — Jimmy Vu
(74) *Attorney, Agent, or Firm* — Greenblum & Bernstein P.L.C.

(57) ABSTRACT

An LED lamp according to one aspect of the present invention including: a first LED array including first LED elements connected in series; a second LED array that includes second LED elements connected in series and emits light having an emission color different from an emission color of the first LED array; a FET switch that is provided between the two LED arrays and switches between a first current path to the first LED array and a second current path to the second LED array; a constant power output circuit that outputs the same power value to a current path through which current flows before the switching and a current path through which current flows after the switching, wherein a total forward voltage of the first LED array is different from a total forward voltage of the second LED array.

17 Claims, 10 Drawing Sheets

(56) References Cited

U.S. PATENT DOCUMENTS

| | | | | |
|---|---|---|---|---|
| 2015/0077001 | A1* | 3/2015 | Takahashi | H05B 33/0803 315/193 |
| 2015/0077002 | A1* | 3/2015 | Takahashi | H05B 33/0803 315/193 |

OTHER PUBLICATIONS

German Office Action, mailed Sep. 3, 2015, for the corresponding German Patent Application No. 102014111740.9 (together with English language translation thereof).

* cited by examiner

LIGHTING SOURCE AND LIGHTING APPARATUS

CROSS REFERENCE TO RELATED APPLICATION

This application claims the benefit of priority of Japanese Patent Application Number 2013-191004, filed Sep. 13, 2013, the entire content of which is hereby incorporated by reference.

TECHNICAL FIELD

The disclosure relates to a lighting source including light-emitting elements such as light-emitting diodes (LEDs), and to a lighting apparatus including the lighting source.

BACKGROUND ART

In recent years, a lighting apparatus using a light-emitting module including semiconductor light-emitting elements such as LEDs has gained in popularity as a substitute for an incandescent light bulb. In general, a change in level of current flowing through an LED chip does not change the emission color of the LED chip. This is because the emission color of the LED chip depends on the bandgap of a semiconductor material included in the LED chip, but does not depend on the current level.

In view of the above, Patent Literature (PTL) 1 (Japanese Unexamined Patent Application Publication No. 2009-09782) discloses an LED module which is capable of changing the emission color in the use of the LEDs.

FIG. 9 is a circuit diagram of a conventional LED module disclosed in PTL 1. As shown in FIG. 9, the LED module 900 includes a red LED array 921 and a white LED array 922 which are connected in parallel. The red LED array 921 includes red LEDs 921*a*, 921*b*, 921*c*, . . . , 921*d*, 921*e*, and 921*f* which are connected in series. The white LED array 922 includes white LEDs 922*a*, 922*b*, . . . , 922*c*, and 922*d* which are connected in series. The white LED array 922 is connected in series to a bipolar transistor 924 and a resistive element 926. The bipolar transistor 924 has a base terminal connected to a variable voltage source 927 via a resistive element 925. Furthermore, the bipolar transistor 924 has a collector terminal connected to the cathode terminal of the white LED 922*d*, and an emitter terminal connected to the resistive element 926.

The LED module 900 is connected to a variable current source 933. Alternating-current (AC) power supplied from an AC source 931 undergoes AC to DC conversion performed by an AC/DC converter 932, and the resulting power is supplied to the variable current source 933. Accordingly, current is supplied to the LED module 900 from the variable current source 933.

The LED module 900 is capable of changing base current by changing base-emitter voltage of the bipolar transistor 924. Here, the collector current increases as the base current of the bipolar transistor 924 increases. This leads to an increase in current flowing through the white LED array 922. By increasing the current flowing through the white LED array 922 among the current supplied from the variable current source 933, the current flowing through the red LED array 921 relatively decreases. As a result, the emission color of the LED module 900 approaches white. On the other hand, by reducing the current flowing through the white LED array 922, the current flowing through the red LED array 921 relatively increases. As a result, the emission color of the LED module 900 approaches orange.

SUMMARY

The LED module disclosed in PTL 1, however, has a configuration for changing the emission color of the LED module 900 according to light adjustment, and is incapable of switching between light-emitting characteristics such as emission colors without changing brightness and power consumption.

The present invention has been conceived in view of the above problem, and an object of the present invention is to provide a lighting source and a lighting apparatus that are capable of minimizing the number of circuit components for switching between the light-emitting characteristics, and switching between the light-emitting characteristics without changing the brightness and the power consumption.

In order to achieve the above object, a lighting source according to one aspect of the present invention including: a first light-emitting unit that includes a plurality of first light-emitting elements connected in series and has a first anode terminal and a first cathode terminal; a second light-emitting unit that includes a plurality of second light-emitting elements connected in series, has a second anode terminal and a second cathode terminal, and has light-emitting characteristics different from light-emitting characteristics of the first light-emitting unit; a first switch element connected in series either one of between the first anode terminal and the second anode terminal and between the first cathode terminal and the second cathode terminal; and a constant power output circuit that (i) has a negative output terminal connected to the first cathode terminal and either one of the second cathode terminal and the first switch element connected to the second cathode terminal, and a positive output terminal connected to the first anode terminal and either one of the second anode terminal and the first switch element connected to the second anode terminal, and (ii) outputs power to the first light-emitting unit and the second light-emitting unit without changing a total value of the power supplied to the first light-emitting unit and the second light-emitting unit between before and after conduction and non-conduction of the first switch element are switched, wherein a first total forward voltage is different from a second total forward voltage, the first total forward voltage being a voltage value obtained by adding a forward voltage of each and every one of the plurality of first light-emitting elements connected in series, and the second total forward voltage being a voltage value obtained by adding a forward voltage of each and every one of the plurality of second light-emitting elements connected in series.

Moreover, in the lighting source according to another aspect of the present invention, the first light-emitting unit may have an emission color that is different from an emission color of the second light-emitting unit.

Furthermore, in the lighting source according to another aspect of the present invention, the first light-emitting unit may have light distribution properties that are different from light distribution properties of the second light-emitting unit.

Moreover, in the lighting source according to another aspect of the present invention, the forward voltage of each of the plurality of first light-emitting elements may be equal to the forward voltage of each of the plurality of second light-emitting elements, and the number of the plurality of first light-emitting elements connected in series may be different from the number of the plurality of second light-emitting elements connected in series.

Furthermore, in the lighting source according to another aspect of the present invention, the first total forward voltage may be greater than the second total forward voltage, a first current path that is a path through which current flows to the first light-emitting unit may bypass the first switch element, a second current path that is a path through which current flows to the second light-emitting unit may pass through the first switch element, if the first switch element is in a non-conduction state, the constant power output circuit may supply the power only to the first light-emitting unit among the first light-emitting unit and the second light-emitting unit, and if the first switch element is in a conduction state, the constant power output circuit may supply main power to the second light-emitting unit.

Moreover, in the lighting source according to another aspect of the present invention, the first total forward voltage and the second total forward voltage may have a difference of at least 4 V, and if the first switch element is in the conduction state, the constant power output circuit may supply the power only to the second light-emitting unit among the first light-emitting unit and the second light-emitting unit.

Furthermore, in the lighting source according to another aspect of the present invention, the first total forward voltage and the second total forward voltage may have a difference of at least 2 V but less than 4 V, and if the first switch element is in the conduction state, the constant power output circuit supplies the main power to the second light-emitting unit, and power less than the main power to the first light-emitting unit.

Moreover, in the lighting source according to another aspect of the present invention, the constant power output circuit may include: an inductor that is connected in parallel to the first light-emitting unit and in parallel to a series-connected portion of the second light-emitting unit and the first switch element; a second switch element connected in series to the inductor between a positive input terminal and a negative input terminal of the constant power output circuit; and an oscillation control unit configured to control conduction and non-conduction of the second switch element, if the second switch element is in a conduction state, the inductor may be charged with current flowing from a power source to the inductor, and if the second switch element is in a non-conduction state, magnetic energy stored in the inductor by the charging may be released to either one of the first light-emitting unit and the second light-emitting unit.

Furthermore, in the lighting source according to another aspect of the present invention, the first light-emitting unit may have an emission color that is incandescent color, and the second light-emitting unit may have an emission color that is daylight color.

Moreover, a lighting apparatus according to another aspect of the present invention includes any of the above-described lighting sources.

Since a lighting source and a lighting apparatus according to an embodiment of the present invention each include LED arrays each having a different total forward voltage, and a constant power output circuit, and minimize the number of circuit components for switching between driving of the LED arrays, the lighting source and the lighting apparatus are capable of reducing the number of the circuit components and switching between light-emitting characteristics without changing brightness and power consumption.

BRIEF DESCRIPTION OF THE DRAWINGS

The figures depict one or more implementations in accordance with the present teaching, by way of examples only, not by way of limitations. In the figures, like reference numerals refer to the same or similar elements.

DETAILED DESCRIPTION (Underlying Knowledge Forming Basis of the Present Invention)

In relation to the conventional LED lamp disclosed in the Background Art section, the inventors have found the following problem.

The LED module disclosed in PTL 1 has a configuration for changing the emission color of the LED module 900 according to light adjustment, and is incapable of switching between only the emission colors without changing brightness and power consumption. In contrast, a configuration of a lighting source as illustrated in FIG. 10 is given as a lighting source capable of switching between emission colors without light adjustment.

Figure 10:
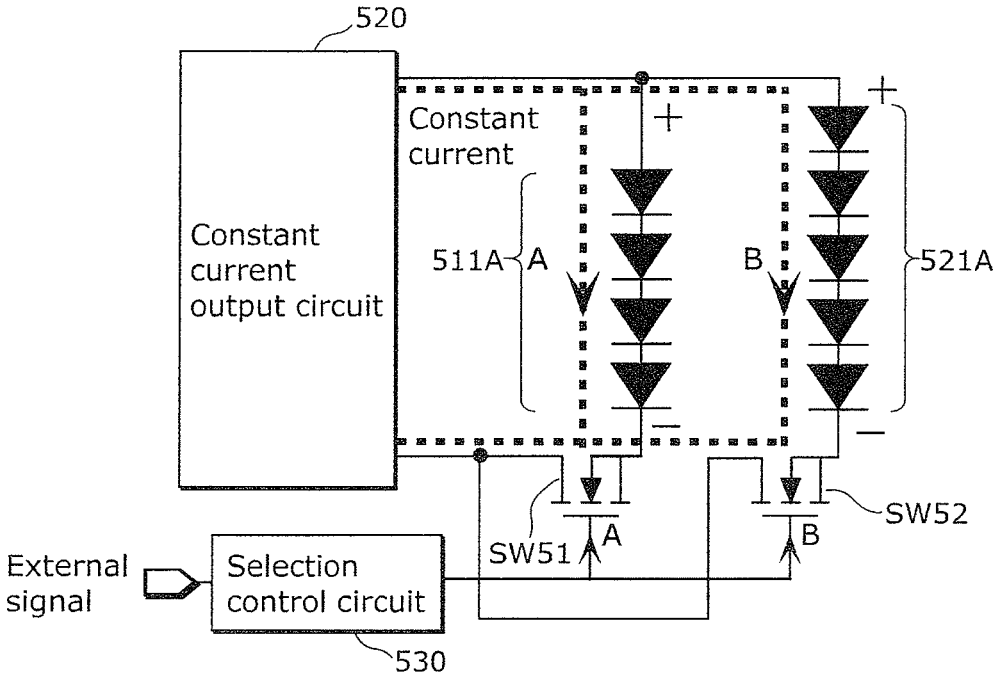
FIG. 10 is a diagram illustrating a configuration of a conventional lighting source capable of switching between emission colors.

FIG. 10 is a diagram illustrating the configuration of the conventional lighting source capable of switching between emission colors. The conventional lighting source illustrated in FIG. 10 includes LED arrays 511A and 521A, FET switches SW51 and SW52, a constant current output circuit 520, and a selection control circuit 530. The LED arrays 511A and 521A each are an array having LEDs connected in series, and have a different emission color. The constant current output circuit 520 is a back converter, for instance, and passes a constant current through one of the LED arrays 511A and 521A if the selection control circuit 530 switches between paths in each of which the constant current flows. In the above configuration, to switch between the emission colors, that is, to switch a current path from one of the LED arrays 511A and 521A to the other of the LED arrays 511A and 521A, it is necessary to exclusively switch between ON and OFF of the FET switches SW51 and SW52 respectively provided in wiring lines of the LED arrays 511A and 521A.

Unfortunately, the following problem occurs if the emission color is switched in the above configuration using the constant current output circuit 520. In general, as a method for making the emission color of each of the LED arrays 511A and 521A different, the emission color is changed by making, while the LED arrays 511A and 521A have the same chip specification, phosphors on the chips different. In this case, the problem occurs that brightness changes when the current path is switched due to a difference in efficiency of the phosphors even if the LED arrays 511A and 521A have the same number of the chips and a constant current is passed. Moreover, if the numbers of the chips of the LED arrays 511A and 521A are varied to prevent the variation in the brightness, the LED arrays 511A and 521A have the same current but differ in generated voltage. If the constant current is passed from the constant current output circuit 520 in this configuration, the problem occurs that the power consumption varies.

In order to solve such a problem, a lighting source according to one aspect of the present invention including: a first light-emitting unit that includes a plurality of first light-emitting elements connected in series and has a first anode terminal and a first cathode terminal; a second light-emitting unit that includes a plurality of second light-emitting elements connected in series, has a second anode terminal and a second cathode terminal, and has light-emitting characteristics different from light-emitting characteristics of the first light-emitting unit; a first switch element connected in series either one of between the first anode terminal and the second anode terminal and between the first cathode terminal and the second cathode terminal; and a constant power output circuit that (i) has a negative output terminal connected to the first cathode terminal and either one of the second cathode terminal and the first switch element connected to the second cathode terminal, and a positive output terminal connected to the first anode terminal and either one of the second anode terminal and the first switch element connected to the second anode terminal, and (ii) outputs power to the first light-emitting unit and the second light-emitting unit without changing a total value of the power supplied to the first light-emitting unit and the second light-emitting unit between before and after conduction and non-conduction of the first switch element are switched, wherein a first total forward voltage is different from a second total forward voltage, the first total forward voltage being a voltage value obtained by adding a forward voltage of each and every one of the plurality of first light-emitting elements connected in series, and the second total forward voltage being a voltage value obtained by adding a forward voltage of each and every one of the plurality of second light-emitting elements connected in series.

According to this aspect, since the LED arrays each having a different total forward voltage and the constant power output circuit are included, and the circuit element for switching between driving of the LED arrays is only the switch element, it is possible to reduce the number of circuit components and switch between light-emitting characteristics without changing the brightness and the power consumption.

Hereinafter, a lighting source and a lighting apparatus according to embodiments of the present invention are described with reference to the drawings. Each of the embodiments to be described below shows a specific example of the present invention. The numerical values, shapes, materials, structural elements, the arrangement and connection of the structural elements, etc. shown in the following embodiments are mere examples, and therefore do not limit the scope of the present invention. Therefore, among the structural elements in the following embodiments, structural elements not recited in any one of the independent claims are described as arbitrary structural elements.

It is to be noted that each of the drawings is a schematic diagram, and is not strictly illustrated. Moreover, the same reference signs are assigned to the same structural components in each drawing.

Embodiment 1

[Configuration of Lighting Apparatus]

Figure 1A:
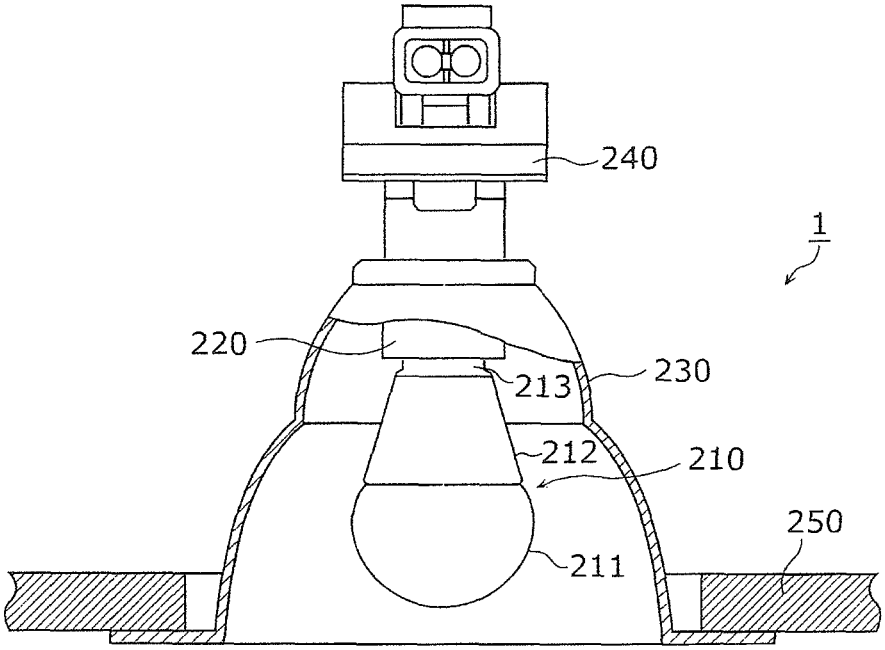
FIG. 1A is a cross-sectional view of a lighting apparatus including an LED lamp according to an embodiment.

FIG. 1A is a cross-sectional view of a lighting apparatus including an LED lamp according to Embodiment 1. As shown in FIG. 1A, an LED lamp 210 is attached to a lighting apparatus 1. The LED lamp 210 is a lighting source that includes a globe 211, an outer case 212, and a base 213, and houses an LED module 10 (not shown in FIG. 1A). Furthermore, a selection control circuit that switches between switch elements according to an external signal, and a constant power output circuit (not shown in FIG. 1A) that supplies constant power to the LED module 10, are provided inside the outer case 212 and the base 213. With this configuration, the constant power is supplied to an LED array selected according to the external signal, and the LED lamp 210 emits light having the emission color of the selected LED array.

The lighting apparatus 1 includes: the LED lamp 210, a socket 220 which is electrically connected to the LED lamp 210 and which holds the LED lamp 210; and a bowl-shaped reflective plate 230 which reflects light emitted from the LED lamp 210 into a predetermined direction. As an example of the lighting apparatus 1 according to Embodiment 1, a so-called downlight lighting appliance is shown.

The lighting apparatus 1 is connected to an external AC source via a connecting portion 240. The reflective plate 230 is attached to a ceiling 250 while the reflective plate 230 abuts the lower surface of the peripheral portion of the opening of the ceiling 250. The socket 220 provided above the reflective plate 230 is located at the back side of the ceiling 250.

Note that the configuration of the lighting apparatus 1 shown in FIG. 1A is a mere example, and the lighting apparatus 1 is not limited to the above downlight lighting appliance.

[Configuration of LED Module]

Figure 1B:
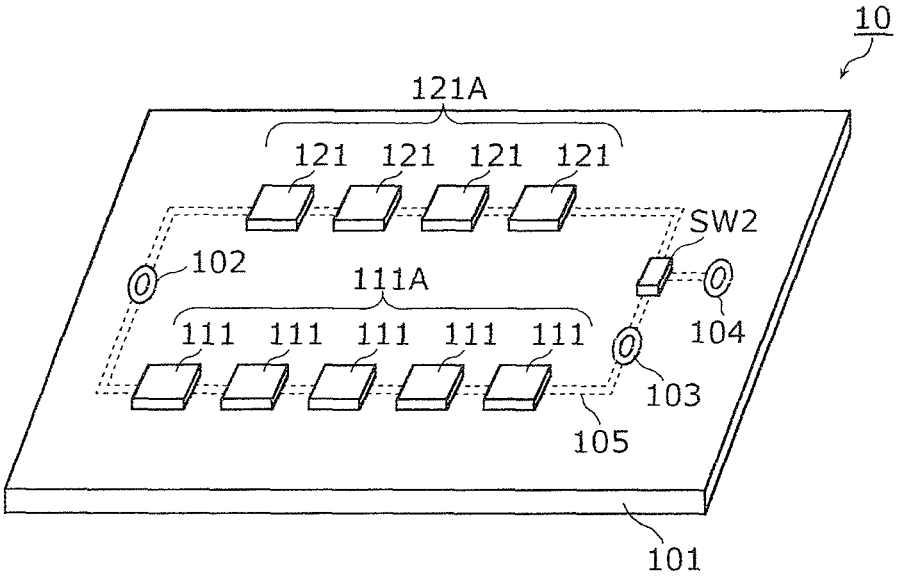
FIG. 1B is a perspective view of an LED module according to Embodiment 1.

FIG. 1B is a perspective view of the LED module according to Embodiment 1. As shown in FIG. 1B, the LED module 10 is a light-emitting module including: a mounting board 101; an LED array 111A; an LED array 121A having a different emission color from an emission color of the LED array 111A; and a FET switch 2. The LED array 111A includes LED elements 111 that are connected in series and are surface-mount devices (SMDs), and the LED array 121A includes LED elements 121 that are connected in series and are the SMDs. Each of the LED elements 111 is a first light-emitting element which includes, for example: a resin package (container); an LED chip mounted in the recess of the package and having a forward voltage Vf of 3 V; and a sealing component including a red phosphor sealed in the recess. The first light-emitting element emits light having incandescent color. Each of the LED elements 121 is a second light-emitting element which includes, for example: a resin package; an LED chip mounted in the recess of the package and having a forward voltage Vf of 3 V; and a sealing component including a white phosphor sealed in the recess. The second light-emitting element emits light having daylight color. It is to be noted that the sealing component is made of, for instance, a translucent material such as silicon resin, and a phosphor.

Here, a first total forward voltage that is a voltage value obtained by adding a forward voltage Vf of each and every one of the LED elements 111 connected in series is different from a second total forward voltage that is a voltage value obtained by adding a forward voltage Vf of each and every one of the LED elements 121 connected in series. In FIG. 1B, the forward voltages of the LED elements 111 are equal to those of the LED elements 121, but the number of the LED elements 111 connected in series (five) is different from that of the LED elements 121 connected in series (four). In other words, the LED arrays differ in total forward voltage, and in amount of voltage drop in the case where current flows through each of the LED arrays. With this, it is possible to selectively pass current to, among current paths of current flowing through the LED arrays, a current path having a small amount of voltage drop.

Moreover, the first total forward voltage is greater than the second total forward voltage, a first current path passing through the LED array 111A is a path bypassing a FET switch SW2, and a second current path passing through the LED array 121A is a path passing through the FET switch SW2. With this configuration, if the FET switch SW2 is in a non-conduction state, the constant power output circuit 20 supplies power only to the LED array 111A, and if the FET switch SW2 is in a conduction state, the constant power output circuit 20 supplies power to the LED array 121A.

It is to be noted that although FIG. 1B illustrates five LED elements 111 and five LED elements 121, the numbers of the LED elements are not limited to these. The LED array 111A and the LED array 121A may differ in an emission light as a difference in configuration between the LED array 111A and the LED array 121A, and their difference in total forward voltage (hereinafter may be referred to as total Vf) obtained by serial addition of forward voltages Vf of respective LEDs may be a forward voltage Vf of substantially one LED, e.g. approximately 2.5 V or higher. This will be described later with reference to FIG. 3A and FIG. 3B.

The mounting board 101 has a wiring pattern 105 which allows wiring to be connected to the LED elements 111 and the LED elements 121. Furthermore, the mounting board 101 has through-holes 102 to 104. The wiring connected to the LED elements 111 and the LED elements 121 is connected to the driving circuit provided inside the outer case 212 and the base 213 of the LED lamp 210, through the through-holes 102 to 104. The wiring is soldered at the through-holes 102 to 104 to be fixed to the mounting board 101.

The shape of the mounting board 101 may be other than quadrilateral as shown in FIG. 1B. The shape of the mounting board 101 may be, for example, circular or elliptical as described in Embodiment 2, corresponding to the shape of the LED lamp 210 to be mounted. The LED arrays 111A and 121A may have layouts other than linear as shown in FIG. 1B. The LED arrays 111A and 121A may be, for example, circular or elliptical corresponding to the shape of the LED lamp 210 to be mounted, or may have a layout in which the LED elements 111 and the LED elements 121 are alternately arranged while maintaining the above electrical connection in the LED arrays 111A and 121A.

[Configuration of LED Lamp]

Figure 2:
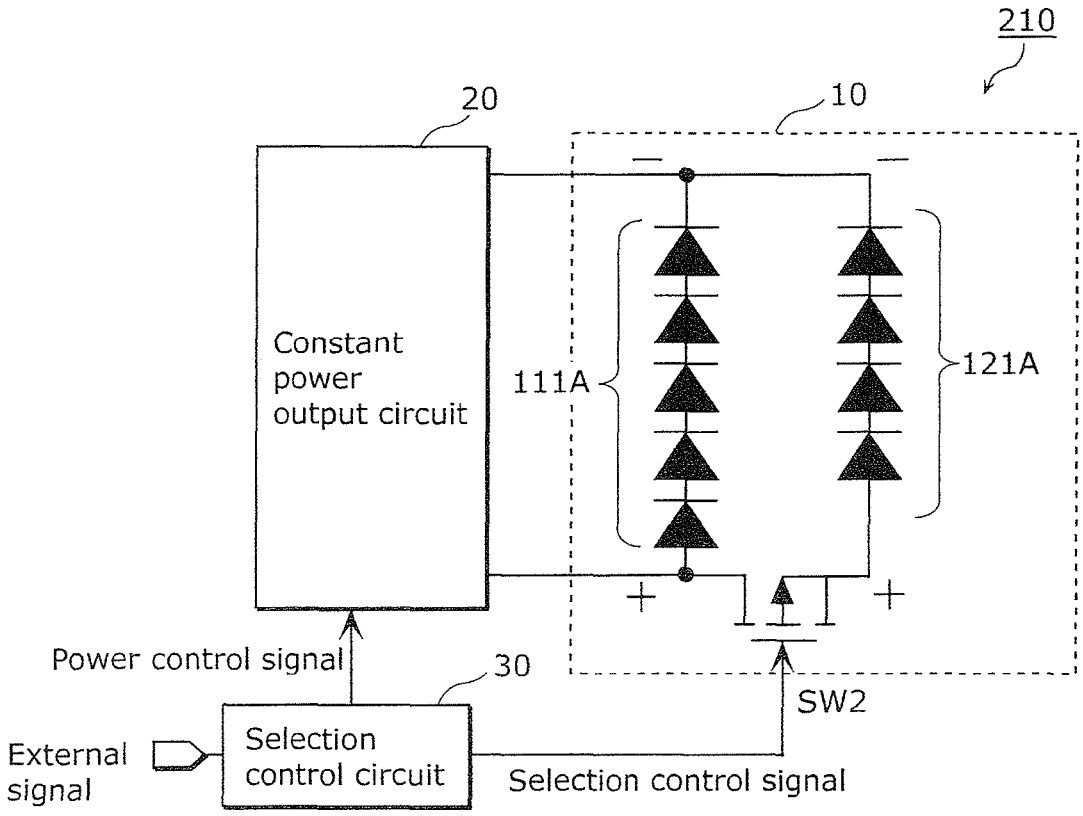
FIG. 2 is a block configuration diagram of the LED lamp according to Embodiment 1.

FIG. 2 is a block configuration diagram of the LED lamp according to Embodiment 1. As illustrated in FIG. 2, the LED lamp 210 includes the LED module 10, the constant power output circuit 20, and the selection control circuit 30. Moreover, as illustrated in FIG. 1B, the LED module 10 includes the LED array 111A, the LED array 121A, and the FET switch SW2.

As illustrated in FIG. 1B, the LED array 111A is a first light-emitting unit that includes the LED elements 111 connected in series and has a first anode terminal and a first cathode terminal. The LED array 121A is a second light-emitting unit that includes the LED elements 121 connected in series, has a second anode terminal and a second cathode terminal, and emits light having a different emission color from an emission color of the first light-emitting unit. Moreover, the cathode terminal of the LED array 111A and the cathode terminal of the LED array 121A are connected, and the anode terminal of the LED array 111A and the anode terminal of the LED array 121A are connected via the FET switch SW2. It is to be noted that although each LED element 111 and each LED element 121 both include the LED chips having an equal forward voltage Vf, the present invention is not limited to this. The LED element 111 and the LED element 121 both do not need to include the LED chips having the equal forward voltage Vf, and may differ in emission color as an array and in total Vf of the whole array.

In this embodiment, for instance, each of the LED elements 111 is a first light-emitting element that includes an LED chip having a forward voltage Vf of 3 V and a sealing material including a red phosphor, and emits light having incandescent color. Each of the LED elements 121 is a second light-emitting element that includes an LED chip having a forward voltage Vf of 3 V and a sealing material including a white phosphor, and emits light having daylight color. Here, assuming that the LED array 111A includes 16 LED elements 111 connected in series, total Vf is 48 V (=3 V×16). Moreover, assuming that the LED array 121A includes 14 LED elements 121 connected in series, total Vf is 42 V (=3 V×14).

The FET switch SW2 is a first switch element that has a source terminal and a drain terminal connected between the first anode terminal and the second anode terminal, and switches between a first current path through which current flows to the first light-emitting unit and a second current path through which current flows to the second light-emitting unit. In other words, the FET switch SW2 has the source terminal and the drain terminal that are connected in series in the second current path having less total Vf out of the first current path through which current flows from the constant power output circuit 20 to the LED array 111A and the second current path through which current flows from the constant power output circuit 20 to the LED array 121A. Moreover, the FET switch SW2 has a gate terminal to which the selection control circuit 30 applies a selection control signal.

Upon receiving an external signal, the selection control circuit 30 outputs a selection control signal and a power control signal to the FET switch SW2 and the constant power output circuit 20, respectively, based on the external signal.

The FET switch SW2 is a p-type FET that switches between ON and OFF according to the selection control signal inputted to the gate terminal. This switching allows the constant output circuit 20 to supply constant power to the LED array 111A or the LED array 121A.

The constant power output circuit 20 does not change an amount of power supplied to the LED module 10 by the on/off operation of the FET switch SW2, under a certain power control signal. To put it another way, the constant power output circuit 20 outputs the same power value to one of the LED array 111A and the LED array 121A through which current flows before conduction and non-conduction of the FET switch SW2 are switched, and the other of the LED array 111A and the LED array 121A through which current flows after the switching. In contrast, the constant power output circuit 20 controls an amount of power supplied to the LED module 10, by duty adjustment based on the PWM technique, for example, according to the power control signal from the selection control circuit 30.

Stated differently, the LED lamp 210 is capable of maintaining brightness and an amount of power relative to the switching between emission colors. In addition, the LED lamp 210 has a function to vary the brightness and the amount of power according to an external (light adjustment) signal.

It is to be noted that although this embodiment exemplifies the configuration in which the two LED arrays are connected in parallel, a configuration in which three or more LED arrays are connected in parallel may be used. For instance, in the case of a configuration in which an n number of LED arrays are connected in parallel, each of the n number of the LED arrays may have different total Vf, and an FET switch may be connected in series between the anode terminals of adjacent LED arrays among the n number of the LED arrays. Note that the FET switch is not provided in a current path passing through an LED array having the greatest total Vf among the n number of the LED arrays. In short, in the case of the configuration in which the n number of the LED arrays are connected in parallel, an (n−1) number of FET switches is necessary.

Figure 3A:
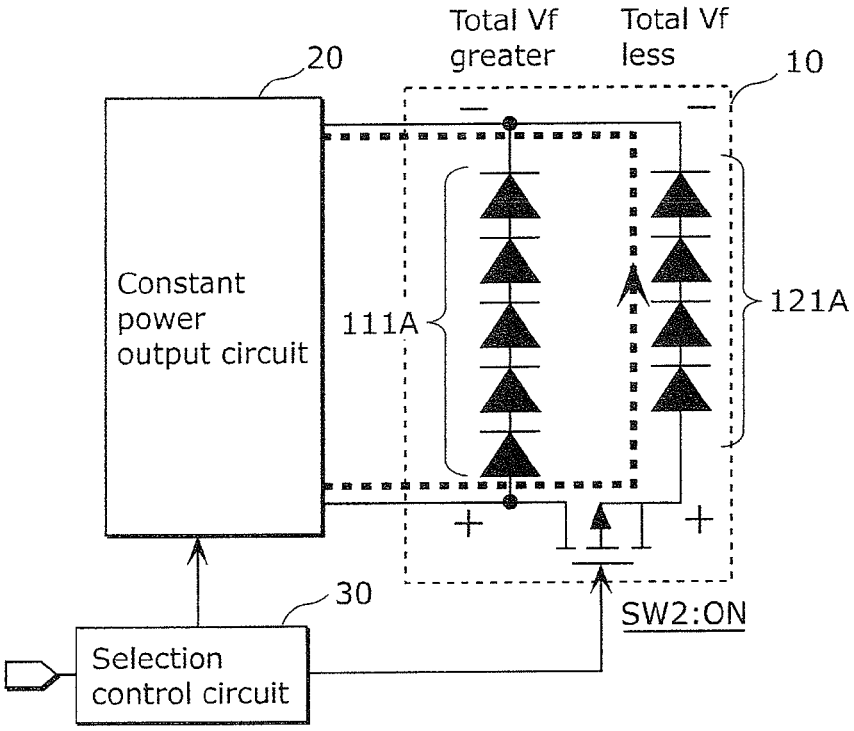
FIG. 3A is a state transition diagram illustrating a current path in the case where a FET switch of the LED lamp according to Embodiment 1 is in the ON state.
Figure 3B:
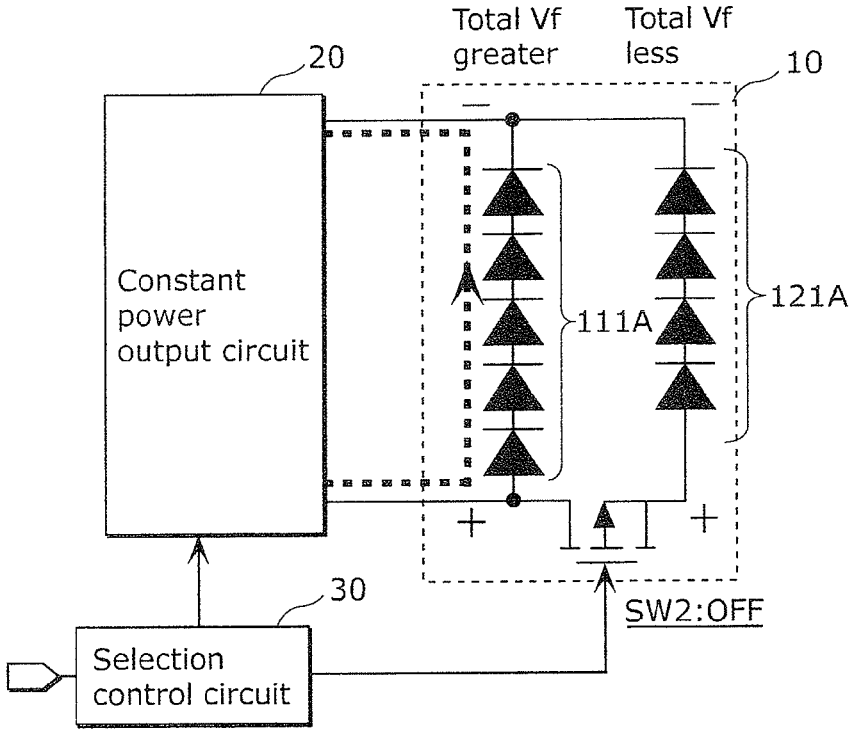
FIG. 3B is a state transition diagram illustrating a current path in the case where the FET switch of the LED lamp according to Embodiment 1 is in the OFF state.

The following describes a relationship between the on/off operation of the FET switch SW2 and a current path with reference to FIG. 3A and FIG. 3B.

FIG. 3A is a state transition diagram illustrating a current path in the case where the FET switch of the LED lamp according to Embodiment 1 is in the ON state. FIG. 3B is a state transition diagram illustrating a current path in the case where the FET switch of the LED lamp according to Embodiment 1 is in the OFF state. Here, as stated above, the total Vf of the LED array 111A is 48 V, the total Vf of the LED array 121A is 42 V, and a difference in total forward voltage is 6 V.

In the above configuration, first, in the case where the FET switch SW2 is in the ON state according to a selection control signal, current supplied from the constant power output circuit 20 flows through the current path passing through the LED array 121A having the less total Vf, and the LED array 121A emits light having daylight color. In other words, in the case where the difference in total Vf between the LED arrays is greater than or equal to 4 V, and the FET switch SW2 is conductive, the constant power output circuit 20 supplies power only to the LED array 121A.

In contrast, in the case where the FET switch SW2 is in the OFF state according to a selection control signal, the current path passing through the LED array 121A is blocked, current supplied from the constant power output circuit 20 flows through the current path passing to the LED array 111A, and the LED array 111A emits light having incandescent color.

Here, for example, the phosphors of the LED array 121A have high luminous efficiency, and the phosphors of the LED array 111A have low luminous efficiency. To connect both the LED arrays 111A and 121A to the constant power output circuit 20 and drive the LED arrays 111A and 121A at the same illuminance, the number of the LED elements connected in series and included in each of the arrays is adjusted such as increasing the number of the LED elements of the LED array 111A having the lower luminous efficiency. This allows the emission color to be switched while the LED array 111A and the LED array 121A have the same illuminance.

In the case where the current flows through the above two current paths, and even if the FET switch SW2 switches between the current paths in a situation where the power control signal is constant, the constant power output circuit 20 is capable of providing the same power value to the LED array 111A and the LED array 121A.

Furthermore, since a circuit element that switches between the current paths of the LED arrays is only the FET switch SW2, it is possible to reduce the number of circuit components, and switch between the emission colors without changing the brightness and the power consumption.

It is to be noted that if the total Vf of the LED array 111A is greater than the total Vf of the LED array 121A by at least 4 V in the state transition of FIG. 3A, it is possible to pass the current through the LED array 121A completely.

In contrast, if the total forward voltage of the LED array 111A is greater than the total forward voltage of the LED array 121A by at least 2 V but less than 4 V, since current dominantly flows through the LED array 121A while very little current flows through the LED array 111A, it is possible to mix the emission colors. To put it another way, in the case where the FET switch SW2 is in the conduction state, the constant power output circuit 20 supplies main power to the LED array 121A, and power less than the main power to the LED array 111A. At this time, the constant power output circuit 20 outputs power to the LED array 111A and the LED array 121A without changing a total value of power supplied to the LED array 111A and the LED array 121A between before and after conduction and non-conduction of the FET switch SW2 are switched.

[Configuration of LED Lamp]

Next, the circuit configuration of the LED lamp 210, and especially the circuit configuration of the constant power output circuit 20 are described with reference to FIG. 4.

Figure 4:
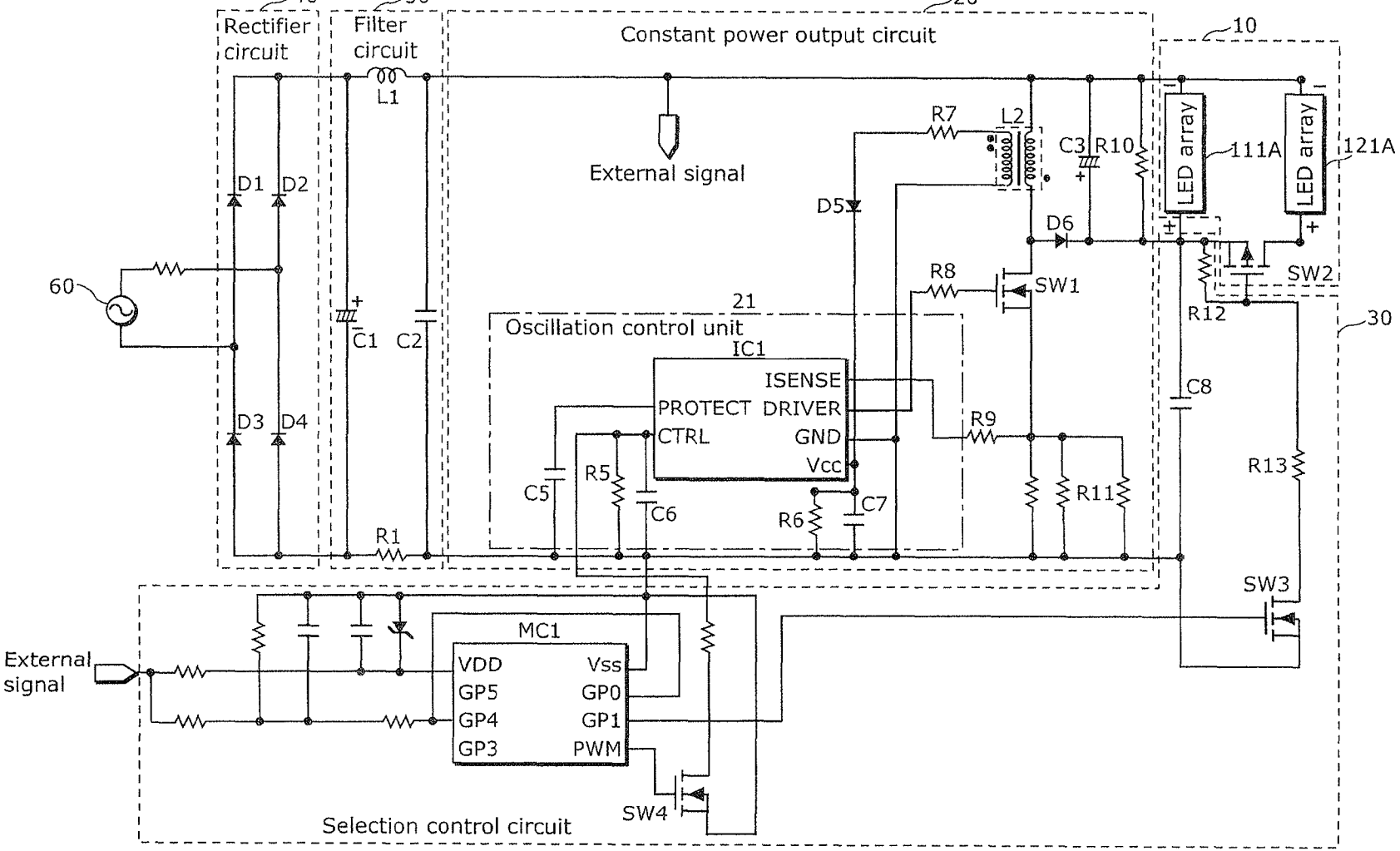
FIG. 4 is a circuit configuration diagram including the LED lamp according to Embodiment 1.

FIG. 4 is a block diagram of a drive circuit including the LED lamp according to Embodiment 1. FIG. 4 illustrates the LED module 10, the constant power output circuit 20, the selection control circuit 30, a rectifier circuit 40, a filter circuit 50, and an alternating-current (AC) source 60. The constant power output circuit 20, the selection control circuit 30, the rectifier circuit 40, and the filter circuit 50 constitute a drive circuit that drives the LED module 10. The LED lamp 210 includes the drive circuit and the LED module 10.

The AC source 60 outputs, for instance, alternating current having a voltage effective value of 100 V.

The rectifier circuit 40 includes, for example, a diode bridge having four diodes D1 to D4.

The filter circuit 50 smoothes, using an electrolytic capacitor C1, current rectified by the rectifier circuit 40, and filters the current into a predetermined frequency.

The constant power output circuit 20 includes a buck-boost circuit in which a primary coil of a transformer L2 is connected in parallel to the LED arrays 111A and 121A and a FET switch SW1 is connected in series to the primary coil of the transformer L2. The current supplied to the constant power output circuit 20 via the rectifier circuit 40 and the filter circuit 50 is stored as magnetic energy in the transformer L2. Moreover, the constant power output circuit 20 releases the magnetic energy stored in the transformer L2 to the LED module 10 with predetermined timing.

The selection control circuit 30 includes a microcontroller MC1 and FET switches SW3 and SW4. For instance, upon receiving an external signal for causing the LED array 121A to emit light, the microcontroller MC1 outputs a selection control signal for turning the FET switch SW3 ON, to a gate of the FET switch SW3. With this, the FET switch SW3 is turned ON, a gate voltage of the FET switch SW2 of p-type is pulled down, and the FET switch SW2 is turned ON. Thus, the current supplied to the LED module 10 selectively flows through the current path passing through the LED array 121A. In contrast, upon receiving an external signal for causing the LED array 111A to emit light, the microcontroller MC1 outputs a selection control signal for turning the FET switch SW3 OFF, to the gate of the FET switch SW3. With this, the FET switch SW3 is turned OFF, a gate voltage of the FET switch SW2 of p-type changes to a high level, and the FET switch SW2 is turned OFF. Thus, the current supplied to the LED module 10 selectively flows through the current path passing through the LED array 111A.

In addition to the above, for example, upon receiving an external signal for varying the brightness (illuminance) of the LED module 10, the microcontroller MC1 outputs a signal for controlling an on/off operation of the FET switch SW3, to a gate of the FET switch SW4. With this, the FET switch SW4 is turned ON or OFF at predetermined intervals, and thus an output control signal for controlling an oscillation frequency of the FET switch SW1 is provided to IC1 of an oscillation control unit 21.

In other words, the FET switch SW3 is a switch element for switching between emission colors, and the FET switch SW4 is a switch element for switching between illuminance.

[Configuration and Operation of Constant Power Output Circuit]

The constant power output circuit 20 includes the transformer L2, the FET switch SW1, a diode D6, a resistor R9, and the oscillation control unit 21. The oscillation control unit 21 includes the IC1 that controls conduction and non-conduction of the FET switch SW1. The following describes a connection relationship of each of the structural elements.

The primary coil of the transformers L2 has a high potential terminal connected to a drain terminal of the FET switch SW1. The constant power output circuit 20 connected to the rectifier circuit 40 and the filter circuit 50 has a positive input terminal connected to a low potential terminal of the primary coil of the transformer L2 (a negative output terminal of the constant power output circuit 20). The FET switch SW1 has a source terminal connected via a resistor R11 to a negative input terminal of the constant power output circuit 20 connected to the rectifier circuit 40 and the filter circuit 50. The resistor R9 is inserted in series between the source terminal of the FET switch SW1 and an ISENSE terminal of the IC1. A secondary coil of the transformer L2 supplies a power supply voltage Vcc of the IC1 via a resistor R7 and a diode D5. The primary coil of the transformer L2 has the high potential terminal connected to an anode terminal of the diode D6, and the diode D6 has a cathode terminal (a positive output terminal of the constant power output circuit 20) connected to the anode terminal of the LED array 111A. The primary coil of the transformer L2 has the low potential terminal connected to the cathode terminal of the LED array 111A. It is to be noted that in this embodiment the transformer L2 has inductance of 0.8 mH, for example.

To put it another way, the transformer L2 is an inductor that is connected in parallel to the LED array 111A and in parallel to a series-connected portion of the LED array 121A and the FET switch SW2. The FET switch SW1 is a second switch element connected in series to the transformer L2 between the positive input terminal and the negative input terminal of the constant power output circuit 20. The constant power output circuit 20 has the negative output terminal connected to the cathode terminals of the LED arrays 111A and 121A, and the positive output terminal connected to the anode terminal of the LED array 111A and the FET switch SW2. The constant power output circuit 20 outputs the same power value to the LED array 111A and the LED array 121A through which the current flows before and after the conduction and non-conduction of the FET switch SW2 are switched.

The following describes in detail a relationship between a switching operation of the FET switches SW1 and SW2 and a light-emitting operation of the LED module 10 in the above circuit configuration.

First, the FET switch SW2 is in the OFF state at time t0. Moreover, the FET switch SW1 is in the ON state, and current rectified and smoothed by the rectifier circuit 40 and the filter circuit 50 flows through the transformer L2 (primary side), the FET switch SW1, and the resistor R11. Meanwhile, magnetic energy stored in the transformer L2 increases due to power supply from a power source. At this time, the IC1 monitors the current flowing through the transformer L2, using the resistor R9. Since the cathode terminals of the LED arrays 111A and 121A are connected to the positive input terminal (negative output terminal) of the constant power output circuit 20, when the transformer L2 is charged, the current does not flow through the LED arrays 111A and 121A.

Next, when the current flowing through the transformer L2 reaches a predetermined current value, the IC1 turns the FET switch SW1 OFF at time t1. At this time, the power supply from the power source is cut off, the magnetic energy stored in the transformer L2 is released to a current path from the transformer L2 (primary side) to the diode D6 to the LED array 111A to the transformer L2 (primary side), and the LED array 111A emits light.

Next, the IC1 turns the FET switch SW1 ON at time t2. With this, the power supply from the power source to the transformer L2 is started, the magnetic energy stored in the transformer L2 increases, and the LED array 111A stops emitting the light.

The IC1 determines, based on a power control signal from the selection control circuit 30, a duty cycle that is a ratio between an ON period (t0 to t1) and an OFF period (t1 to t2) of the FET switch SW1, and controls the FET switch SW1 using pulse-width modulation. Constant power is supplied to the LED module 10 by repeatedly turning the FET switch SW1 ON and OFF according to the duty cycle, and the LED module 10 emits light at predetermined illuminance. Here, power corresponding to the magnetic energy stored in the transformer L2 is supplied to the LED array 111A in a period when the FET switch SW2 is in the OFF state. It is to be noted that in this embodiment the FET switch SW1 has a switching frequency of 66.5 kHz, for instance.

Next, an external signal for switching between emission colors is inputted to the selection control circuit 30 at time t3. At this time, the FET switch SW3 changes to the ON state, and thus the FET switch SW2 changes to the ON state.

Next, when the current flowing through the transformer L2 reaches a predetermined current value, the IC1 turns the FET switch SW1 OFF at time t4. At this time, the power supply from the power source is cut off, the magnetic energy stored in the transformer L2 is released to the current path from the transformer L2 (primary side) to the diode D6 to the LED array 121A to the transformer L2 (primary side), and the LED array 121A emits light.

Next, the IC1 turns the FET switch SW1 ON at time t5. With this, the power supply from the power source to the transformer L2 is started, the magnetic energy stored in the transformer L2 increases, and the LED array 121A stops emitting the light.

Between the time t3 and the time t5, the IC1 controls, based on the same power control signal as the power control signal in the period between the time 0 and the time t3, the FET switch SW1 with the same duty cycle as the duty cycle between the time t0 and the time t2, using pulse-width modulation. The LED module 10 is set to the same illuminance as the illuminance between the time t0 and the time t3 based on the duty cycle. Here, the same power as the power supplied to the LED array 111A in the period when the FET switch SW2 is in the OFF state is supplied to the LED array 121A in a period when the FET switch SW2 is in the ON state.

In other words, if the FET switch SW1 is in the conduction state, the transformer L2 is charged with the current flowing from the power source to the primary coil of the transformer L2, and if the FET switch SW1 is in the non-conduction state, the magnetic energy stored in the primary coil of the transformer L2 by the charging is released to the LED array 111A or the LED array 121A. Moreover, by providing a capacitor C3 in parallel to the LED array 111A, it is possible to smooth the current flowing through the LED array, and reduce a variation in optical output.

In the above configuration and operation, the LED lamp 210 according to this embodiment uses the constant power output circuit instead of the constant current circuit used as a drive circuit of the conventional lighting source, and thus the power corresponding to only the predetermined amount of the magnetic energy stored in the transformer L2 is supplied to the LED array. Therefore, even if amounts of voltage drop of the current paths provided to the LED module 10 differ, the power supplied to each LED array is constant.

It is to be noted that according to the constant power output circuit 20 that is buck-boost, the magnetic energy is continuously stored during the period when the FET switch SW1 is ON, and thus it is possible to sufficiently supply power to an LED array having a greater total forward voltage.

It is to be noted that although the FET switch SW2 is disposed on a high potential side of the LED arrays 111A and 121A in the circuit configuration of the LED module 10, the FET switch SW2 may be disposed on a low potential side of the LED arrays 111A and 121A.

It is to be noted that although the drive circuit included in the LED lamp 210 uses the FET as the switch element in this embodiment, the drive circuit may use a bipolar transistor.

Figure 5:
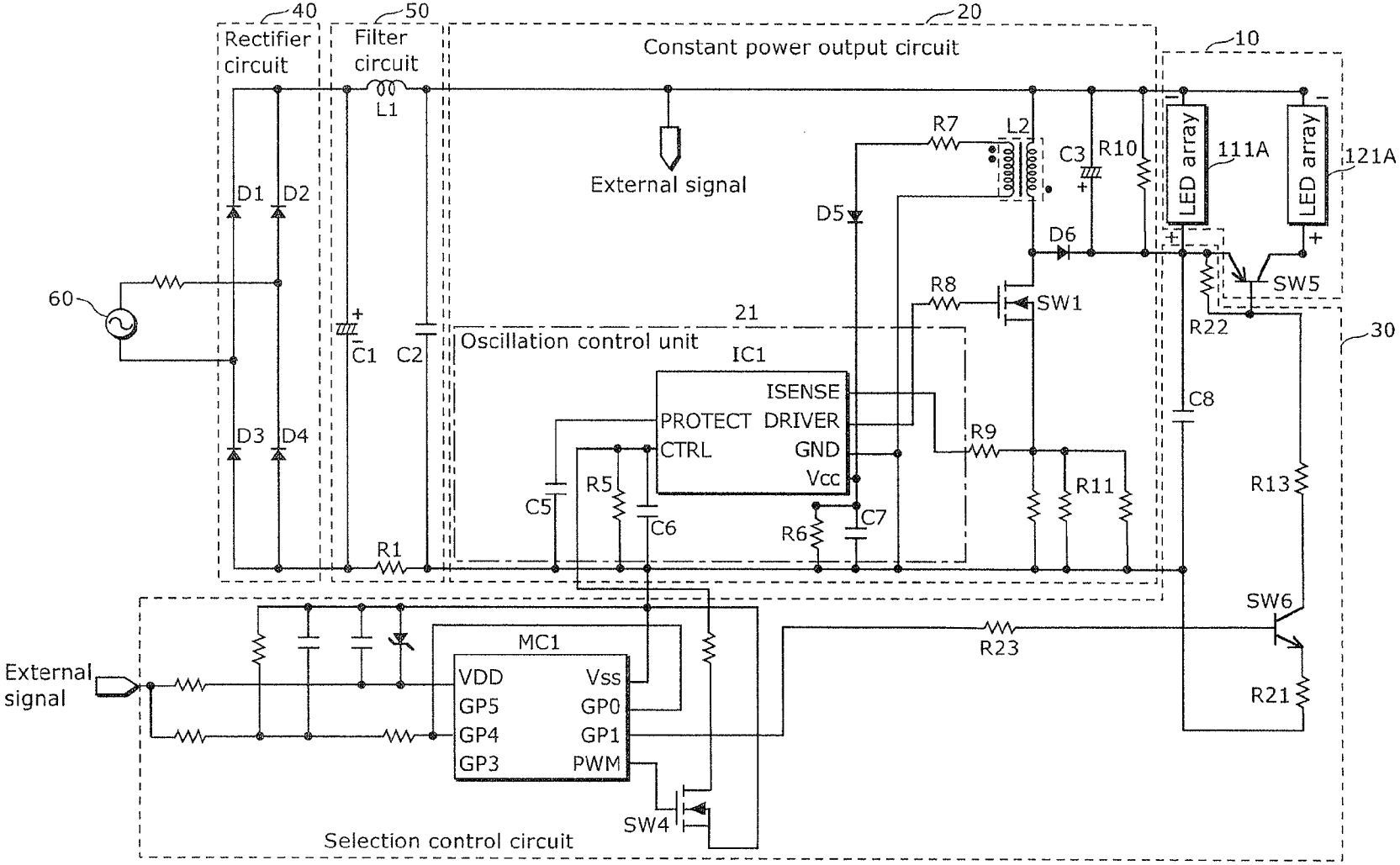
FIG. 5 is a circuit configuration diagram including an LED lamp according to a modification of Embodiment 1.

FIG. 5 is a circuit configuration diagram including the LED lamp according to a modification of Embodiment 1. A configuration of a drive circuit illustrated in FIG. 5 differs from the configuration of the drive circuit illustrated in FIG. 4 in that a PNP bipolar transistor SW5 instead of the FET switch SW2 is provided as a switch element of the LED module 10 and in that an NPN bipolar transistor SW6 instead of the FET switch SW3 is provided as a switch element of the selection control circuit 30.

For instance, upon receiving an external signal for causing the LED array 121A to emit light, the microcontroller MC1 outputs a selection control signal for passing a base-emitter current of the bipolar transistor SW6, to a base of the bipolar transistor SW6. With this, the bipolar transistor SW6 is turned ON, and an emitter-base current of the PNP bipolar transistor SW5 and an emitter-collector current of the bipolar transistor SW flow due to a collector-emitter current of the bipolar transistor SW6. Thus, the current supplied to the LED module 10 selectively flows through the current path passing through the LED array 121A. In contrast, upon receiving an external signal for causing the LED array 111A to emit light, the microcontroller MC1 outputs a selection control signal for turning the bipolar transistor SW6 OFF, to the base of the bipolar transistor SW6. With this, the bipolar transistor SW6 is turned OFF, and the bipolar transistor SW5 is also turned OFF. Thus, the current supplied to the LED module 10 selectively flows through the current path passing through the LED array 111A.

As described above, the LED lamp 210 according to this embodiment includes the LED arrays each having the different total forward voltage and the different emission color that is part of the light-emitting characteristics, and the constant power output circuit 20, the circuit element for switching between the driving of the LED arrays is only the FET switch SW2, and the number of circuit elements is minimized. Thus, it is possible to reduce the number of the circuit components, and switch the emission color without changing the brightness and the power consumption.

Embodiment 2

Hereinafter, an LED lamp according to Embodiment 2 is described with reference to the drawings. It is to be noted that the description of the same configuration as the LED lamp 210 according to Embodiment 1 is omitted, and different configurations from the LED lamp 210 are mainly described below.

[Configuration of LED Lamp]

This embodiment describes a lighting source capable of switching between light distribution properties with the same power consumption by causing the FET switch SW2 to switch between current paths of current flowing through two LED arrays.

Figure 6:
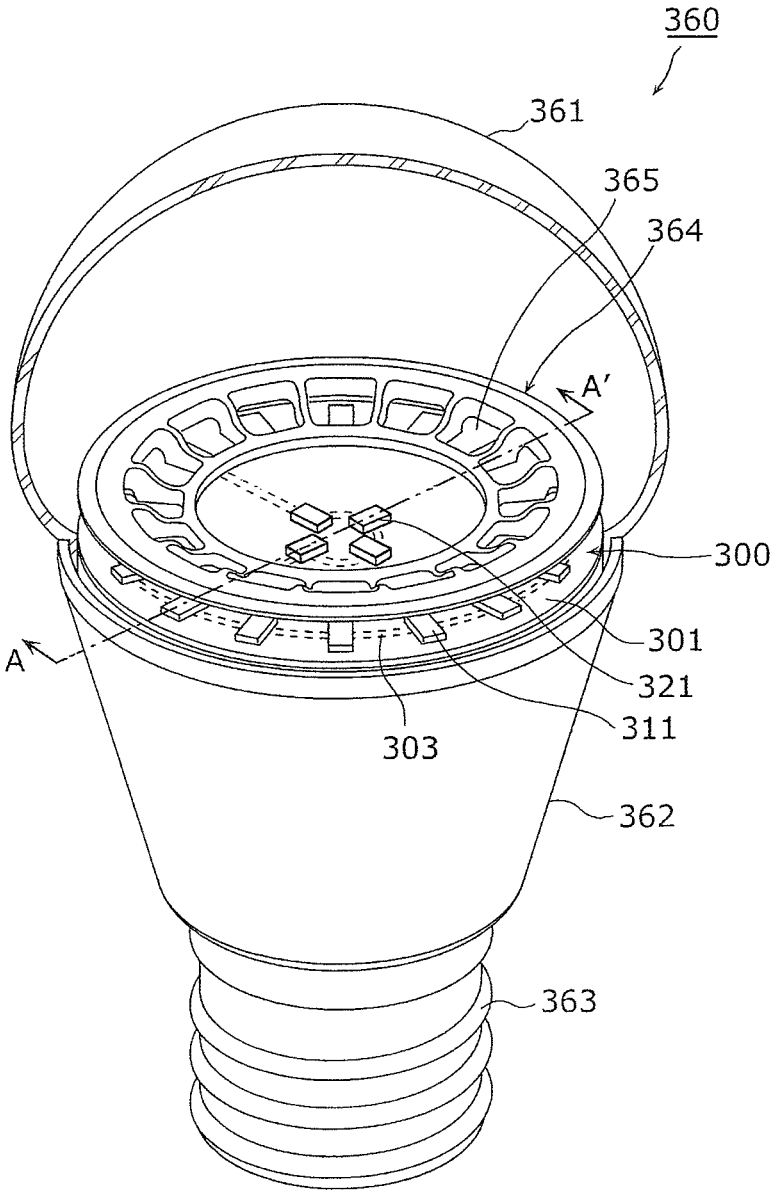
FIG. 6 is a perspective view of an LED lamp according to Embodiment 2.

FIG. 6 is a perspective view of an LED lamp according to Embodiment 2. An LED lamp 360 is attached to the lighting apparatus 1 shown in FIG. 1A. The LED lamp 360 includes a globe 361, an outer case 362, and a base 363, and houses an LED module 300. Furthermore, the selection control circuit 30 that switches between switch elements according to an external signal, and the constant power output circuit 20 (not shown in FIG. 6) that supplies constant power to the LED module 300, are provided inside the outer case 362 and the base 363.

In the LED lamp 360, an upper surface of an approximately ring shaped base platform serves as a mounting board 301 on which LED elements 311 and LED elements 321 that are SMDs are mounted.

Figure 7:
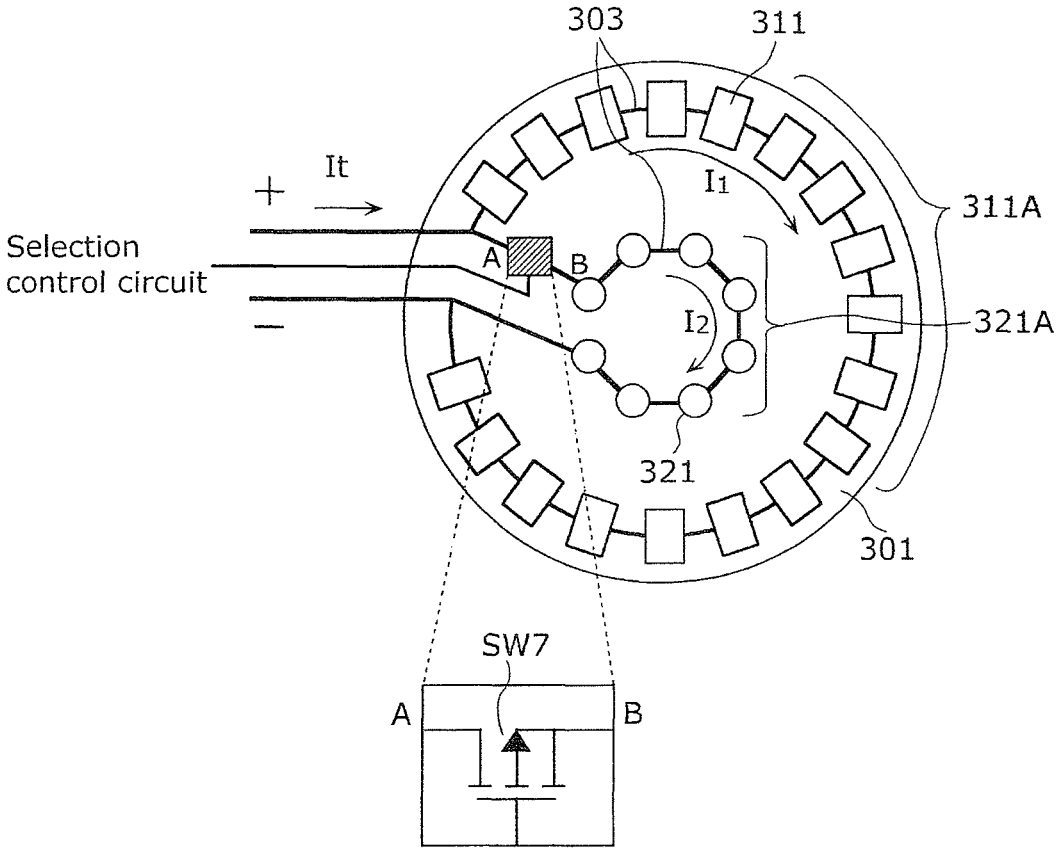
FIG. 7 is an exemplary layout view of components in an LED module according to Embodiment 2.

FIG. 7 is an exemplary layout view of components in an LED module according to Embodiment 2. The LED module 300 is a light-emitting module including an LED array 311A, an LED array 321A having different light distribution properties from the LED array 311A, and a FET switch SW7 disposed near a second current path I2. Here, a first total forward voltage obtained by serial addition of a forward voltage of each and every one of the LED elements 311 is set greater than a second total forward voltage obtained by serial addition of a forward voltage of each and every one of the LED elements 321.

The LED array 311A includes the LED elements 311 that are connected in series and arranged in a ring shape, and the LED array 321A includes the LED elements 321 that are connected in series and arranged in the ring shape along the inner perimeter of the LED array 311A. Each of the LED elements 311 is a first light-emitting element which includes, for example, a resin package, an LED chip mounted in the recess of the package and having a forward voltage Vf of 3 V, and a sealing component including a white phosphor sealed in the recess. The first light-emitting emits light having daylight color. Each of the LED elements 321 is a second light-emitting element which includes, for example, a resin package, an LED chip mounted in the recess of the package and having a forward voltage Vf of 3 V, and a sealing component including a white phosphor sealed in the recess. The second light-emitting element emits light having daylight color. It is to be noted that the sealing component is made of, for instance, a translucent material such as silicon resin, and a phosphor.

Although FIG. 7 illustrates eighteen LED elements 311 and eight LED elements 321, the numbers of the LED elements are not limited to these. The LED array 311A and the LED array 321A may differ in mounting position as a difference in configuration between the LED array 311A and the LED array 321A, and their difference in total forward voltage (hereinafter may be referred to as total Vf) obtained by serial addition of forward voltages Vf of respective LEDs may be a forward voltage Vf of substantially one LED, e.g. approximately 2.5 V or higher.

The LED array 311A and the constant power output circuit 20 form a first current path, and the LED array 321A, the FET switch SW7, and the constant power output circuit 20 form a second current path.

The layouts of the LED arrays 311A and 321A are not limited to the ring shape as illustrated in FIG. 7 or a centralized arrangement. The layouts may be, for instance, a rectangular arrangement or an elliptical arrangement in conformity to the shape of the LED lamp 360 to be mounted.

Moreover, the mounting board 301 is not limited to a substantially ring shape, and may have any shape in conformity to the shape of the LED lamp 360. Furthermore, the surface of the mounting board 301 needs not be entirely flat if the LEDs can be arranged planarly. In addition, the back surface of the mounting board 301 is not limited to be a flat surface.

The LED module 300 is, for example, screwed to the base platform together with a reflective component 364. The LED module 300 may also be fixed to the base platform through adhesion or engagement.

The reflective component 364 is a substantially circular cylinder having a larger outside diameter at the upper portion than the lower portion. The reflective component 364 is provided above the LED module 300 while not contacting the LED array 311A and in such a manner that the cylindrical axis of the reflective component 364 and the surface of the mounting board 301 are orthogonal to each other.

The reflective component 364 includes a plurality of openings 365 arranged at a distance from each other along the circumferential direction of the outer periphery. More specifically, the same number of the openings 365 as the LEDs 311 is equally spaced along the circumferential direction of the outer periphery such that the openings 365 are opposed to the LEDs 311 in one-to-one correspondence.

In this embodiment, each opening 365 is a through-hole and has nothing fit inside; however, the opening 365 may have a configuration other than the above as long as light is allowed to exit upward. For example, it may be that a translucent component is fit into the opening 365 entirely or partially allowing light passing through the translucent component to exit forward. Furthermore, the number of the openings 365 may be different from the number of the LEDs 311, and may be less or greater than the number of the LEDs 311, or may be one or plural.

Figure 8:
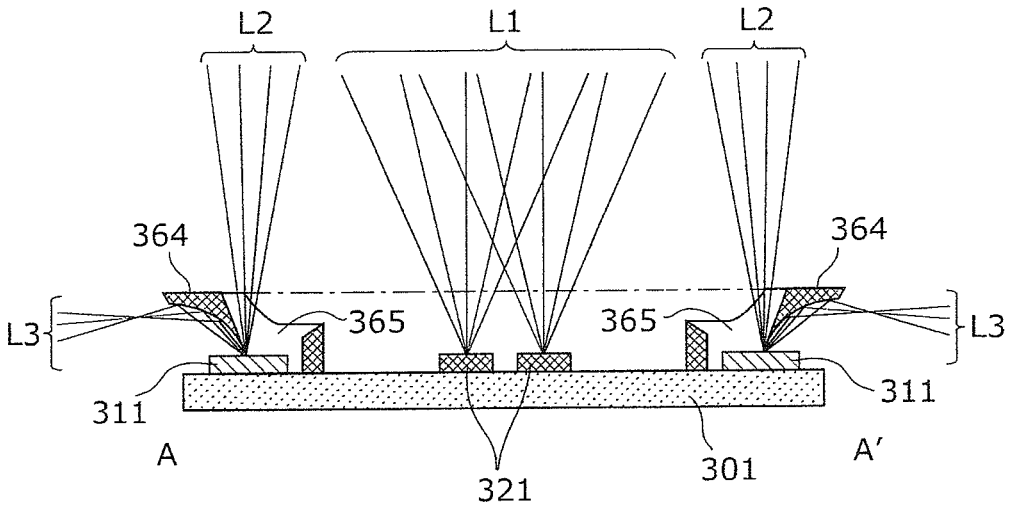
FIG. 8 is a schematic cross-sectional view of optical paths from the LED module according to Embodiment 2.
Figure 9:
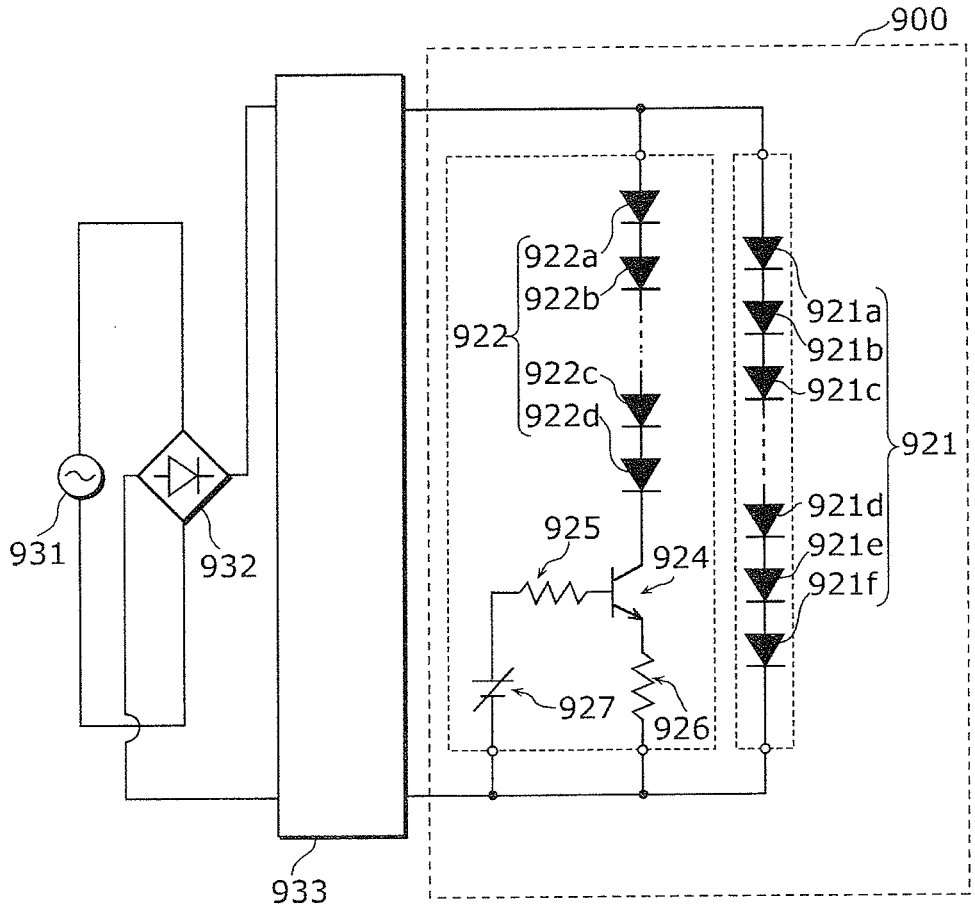
FIG. 9 Prior Art
FIG. 9 is a circuit diagram of a conventional LED module disclosed in PTL 1.

FIG. 8 is a schematic cross-sectional view of optical paths from the LED module according to this embodiment. As shown in FIG. 8, light emitted from the LED elements 321 travels along light paths L1 in an upward direction. On the other hand, light emitted from the LED elements 311 has a component which passes through the opening 365 and travels along light paths L2 in an upward direction and a component which is reflected by the outer peripheral surface of the reflective component 364 and travels along optical paths L3 to the side laterally. More specifically, light emitted from the LED elements 311 is diffused into the upper and lateral directions by the reflective component 364. With this, the LED array 321A and the LED array 311A have different light distribution angles. The LED array 311A has a greater light distribution angle than that of the LED array 321A.

Here, since the LED array 321A is on the inner side of the LED array 311A, the number of the LED elements connected in series of the LED array 321A is less than that of the LED array 311A. Thus, the total Vf of the LED array 321A is less than that of the LED array 311A. In contrast, since the emitted light of the LED array 311A travels after being partially reflected by the reflective component 364, light extraction efficiency to the outside of the globe 361 in the case where the LED array 311A emits the light is lower than light extraction efficiency in the case where the LED array 321A emits light. In other words, the LED array 311A having the lower light extraction efficiency has more LED elements, and the LED array 321A having the higher light extraction efficiency has less LED elements. Moreover, the configuration of the drive circuit of the LED lamp 360 thus configured is the same as the circuit illustrated in FIG. 4 according to Embodiment 1. In the configuration, even if the FET switch SW7 switches between the current paths in a situation where the power control signal is constant, the constant power output circuit 20 supplies the same power to the LED array 311A and the LED array 321A. With this, it is possible to switch between the light distribution properties without changing the amount of power supplied to the LED module between before and after the switching by the FET switch SW7.

As described above, the LED lamp 360 according to this embodiment includes the LED arrays each having the different total forward voltage and the different light distribution angle that is part of the light-emitting characteristics, and the constant power output circuit 20, the circuit element for switching between the driving of the LED arrays is only the FET switch SW7, and the number of circuit elements is minimized. Thus, it is possible to reduce the number of the circuit components, and switch between the light distribution properties without changing the brightness and the power consumption.

(Miscellaneous)

According to Embodiments 1 and 2, since the LED arrays each having the different total forward voltage, and the constant power output circuit, are included, and the number of the circuit components for switching between the driving of the LED arrays is minimized, it is possible to reduce the number of the circuit components, and switch between the light-emitting characteristics such as the emission colors and the light distribution properties without changing the brightness and the power consumption.

Although the lighting source and the lighting apparatus according to one aspect of the present invention have been described based on Embodiments 1 and 2, the present invention is not limited to these embodiments. The herein disclosed subject matter is to be considered descriptive and illustrative only, and the appended Claims are of a scope intended to cover and encompass not only the particular embodiments disclosed, but also equivalent structures, methods, and/or uses.

Moreover, although the packaged LED elements that are the SMDs are used as the LED module in Embodiments 1 and 2, the present invention is not limited to this. For instance, a chip-on-board LED module having LED chips directly mounted on a mounting board and collectively sealed with a phosphor-containing resin (sealing component) may be the LED module.

Furthermore, although, for example, the LED elements connected in series are assumed as the configuration of each LED array in Embodiments 1 and 2, the LED array may include one LED element. In this case, however, it is required that the LED elements each have a different forward voltage and different light-emitting characteristics.

Moreover, although the LED array 111A which emits the light having the incandescent color and the LED array 121A which emits the light having the daylight color are switched in Embodiments 1 and 2, the present invention is not limited to this. For instance, three LED arrays which respectively emit red light, green light, and blue light may be switched without changing brightness and power consumption.

Furthermore, although the LED module is applied to the bulb-shaped lamp in the embodiments, the present invention is not limited to this. For example, the LED module may be also applied to a ceiling light and a halogen lamp.

Moreover, the lighting apparatus includes the LED lamp 210 or 360, but may include two or more LED lamps 210 or 360.

The circuit configurations in the above circuit diagrams are shown as examples. The present invention is not limited to the examples. More specifically, the present invention also includes a circuit which achieves the characteristic functions of the present invention in the similar manner to the above circuit configurations. For example, the present invention includes a circuit in which an element is connected to another element such as a transistor, a resistive element, a capacitive element, and an inductive element in series or in parallel, in a range which allows the functions similar to those of the above circuit configurations. In other words, the expression "is (are) connected" in the above embodiments is not limited to the case where two terminals (nodes) are directly connected, but also includes the case where the two terminals (nodes) are connected via an element in a range which allows the similar functions.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting source comprising:

a first light-emitting unit that includes a plurality of first light-emitting elements connected in series and has a first anode terminal and a first cathode terminal;

a second light-emitting unit that includes a plurality of second light-emitting elements connected in series, has a second anode terminal and a second cathode terminal, and has light distribution properties different from light distribution properties of the first light-emitting unit;

a first switch element connected in series either between one of the first anode terminal and the second anode terminal or between one of the first cathode terminal and the second cathode terminal; and a constant power output circuit that (i) has a negative output terminal connected to the first cathode terminal and either one of the second cathode terminal and the first switch element connected to the second cathode terminal, and a positive output terminal connected to the first anode terminal and either one of the second anode terminal and the first switch element connected to the second anode terminal, and (ii) outputs power to the first light-emitting unit and the second light-emitting unit without changing a total value of the power supplied to the first light-emitting unit and the second light-emitting unit before and after switching of the first switch element between conduction and non-conduction states, wherein a first total forward voltage is different from a second total forward voltage, the first total forward voltage being a voltage value obtained by adding a forward voltage of each one of the plurality of first light-emitting elements connected in series, and the second total forward voltage being a voltage value obtained by adding a forward voltage of each one of the plurality of second light-emitting elements connected in series.

2. The lighting source according to claim 1, wherein the first light-emitting unit has an emission color that is different from an emission color of the second light-emitting unit.

3. The lighting source according to claim 1, wherein the forward voltage of each of the plurality of first light-emitting elements is equal to the forward voltage of each of the plurality of second light-emitting elements, and the number of the plurality of first light-emitting elements connected in series is different from the number of the plurality of second light-emitting elements connected in series.

4. The lighting source according to claim 1, wherein the first total forward voltage is greater than the second total forward voltage, a first current path, that is a path through which current flows to the first light-emitting unit, bypasses the first switch element, a second current path, that is a path through which current flows to the second light-emitting unit, passes through the first switch element, when the first switch element is in a non-conduction state, the constant power output circuit supplies power only to the first light-emitting unit of the first light-emitting unit and the second light-emitting unit, and when the first switch element is in a conduction state, the constant power output circuit supplies main power to the second light-emitting unit.

5. The lighting source according to claim 4, wherein the first total forward voltage and the second total forward voltage have a difference of at least 4 V, and when the first switch element is in the conduction state, the constant power output circuit supplies power only to the second light-emitting unit of the first light-emitting unit and the second light-emitting unit.

6. The lighting source according to claim 4, wherein the first total forward voltage and the second total forward voltage have a difference of at least 2 V and less than 4 V, and when the first switch element is in the conduction state, the constant power output circuit supplies main power to the second light-emitting unit, and power less than the main power to the first light-emitting unit.

7. The lighting source according to claim 1, wherein the constant power output circuit includes:

an inductor connected in parallel to the first light-emitting unit and in parallel to a series-connected portion of the second light-emitting unit and the first switch element;

a second switch element connected in series to the inductor between a positive input terminal and a negative input terminal of the constant power output circuit; and an oscillation controller configured to control conduction and non-conduction states of the second switch element, when the second switch element is in a conduction state, the inductor is charged with current flowing from a power source to the inductor, and when the second switch element is in a non-conduction state, magnetic energy stored in the inductor by the charging is released to either one of the first light-emitting unit and the second light-emitting unit.

8. The lighting source according to claim 1, wherein the first light-emitting unit has an emission color that is incandescent color, and the second light-emitting unit has an emission color that is daylight color.

9. A lighting apparatus comprising the lighting source according to claim 1.

10. A lighting source comprising:

a first light-emitting unit that includes a plurality of first light-emitting elements connected in series and has a first anode terminal and a first cathode terminal;

a second light-emitting unit that includes a plurality of second light-emitting elements connected in series, has a second anode terminal and a second cathode terminal, and has light-emitting characteristics different from light-emitting characteristics of the first light-emitting unit;

a first switch element connected in series either between one of the first anode terminal and the second anode terminal or between one of the first cathode terminal and the second cathode terminal; and a constant power output circuit that (i) has a negative output terminal connected to the first cathode terminal and either one of the second cathode terminal and the first switch element connected to the second cathode terminal, and a positive output terminal connected to the first anode terminal and either one of the second anode terminal and the first switch element connected to the second anode terminal, and (ii) outputs power to the first light-emitting unit and the second light-emitting unit without changing a total value of the power supplied to the first light-emitting unit and the second light-emitting unit before and after switching of the first switch element between conduction and non-conduction states, wherein a first total forward voltage is different from a second total forward voltage, the first total forward voltage being a voltage value obtained by adding a forward voltage of each one of the plurality of first light-emitting elements connected in series, and the second total forward voltage being a voltage value obtained by adding a forward voltage of each one of the plurality of second light-emitting elements connected in series, the forward voltage of each of the plurality of first light-emitting elements is equal to the forward voltage of each of the plurality of second light-emitting elements, and the number of the plurality of first light-emitting elements connected in series is different from the number of the plurality of second light-emitting elements connected in series.

11. The lighting source according to claim 10, wherein the first light-emitting unit has an emission color that is different from an emission color of the second light-emitting unit.

12. The lighting source according to claim 10, wherein the first total forward voltage is greater than the second total forward voltage, a first current path, that is a path through which current flows to the first light-emitting unit, bypasses the first switch element, a second current path, that is a path through which current flows to the second light-emitting unit, passes through the first switch element, when the first switch element is in a non-conduction state, the constant power output circuit supplies power only to the first light-emitting unit of the first light-emitting unit and the second light-emitting unit, and when the first switch element is in a conduction state, the constant power output circuit supplies main power to the second light-emitting unit.

13. The lighting source according to claim 11, wherein the first total forward voltage and the second total forward voltage have a difference of at least 4 V, and when the first switch element is in the conduction state, the constant power output circuit supplies power only to the second light-emitting unit of the first light-emitting unit and the second light-emitting unit.

14. The lighting source according to claim 11, wherein the first total forward voltage and the second total forward voltage have a difference of at least 2 V and less than 4 V, and when the first switch element is in the conduction state, the constant power output circuit supplies main power to the second light-emitting unit, and power less than the main power to the first light-emitting unit.

15. The lighting source according to claim 10, wherein the constant power output circuit includes:

an inductor connected in parallel to the first light-emitting unit and in parallel to a series-connected portion of the second light-emitting unit and the first switch element;

a second switch element connected in series to the inductor between a positive input terminal and a negative input terminal of the constant power output circuit; and an oscillation controller configured to control conduction and non-conduction states of the second switch element, when the second switch element is in a conduction state, the inductor is charged with current flowing from a power source to the inductor, and when the second switch element is in a non-conduction state, magnetic energy stored in the inductor by the charging is released to either one of the first light-emitting unit and the second light-emitting unit.

16. The lighting source according to claim 10, wherein the first light-emitting unit has an emission color that is incandescent color, and the second light-emitting unit has an emission color that is daylight color.

17. A lighting apparatus comprising the lighting source according to claim 10.

* * * * *